United States Patent [19]

Tippmann et al.

[11] 4,271,622

[45] Jun. 9, 1981

[54] DASHER BOARD FOR ICE SKATING RINKS AND METHOD OF MAKING SAME

[76] Inventors: Joseph R. Tippmann, 211 West St., New Haven, Ind. 46774; Richard G. Daugherty, 2117 Reed Rd., Fort Wayne, Ind. 46805

[21] Appl. No.: 67,937

[22] Filed: Aug. 20, 1979

[51] Int. Cl.[3] ..... G09F 15/00

[52] U.S. Cl. ..... 40/606; 40/611; 256/24

[58] Field of Search ..... 40/584, 605, 606, 610, 40/611, 612, 156, 159, 489, 490; 256/24, 25

[56] References Cited

U.S. PATENT DOCUMENTS

| | | | |
|---|---|---|---|
| 1,412,769 | 4/1922 | Barnes | 40/606 |
| 1,787,335 | 12/1930 | Anderson | 40/611 |
| 3,005,277 | 10/1961 | Sherron | 40/611 |
| 3,332,667 | 7/1967 | Armstrong | 256/24 X |
| 3,727,888 | 4/1973 | Nickolas | 256/24 |
| 3,793,756 | 2/1974 | Kay et al. | 40/611 X |
| 3,803,738 | 4/1974 | Weiss | 40/611 X |
| 3,844,539 | 10/1974 | Abbott | 256/24 |
| 3,883,120 | 5/1975 | Tippmann | 256/24 |
| 4,161,834 | 7/1979 | Hendricks, Jr. | 40/606 |

FOREIGN PATENT DOCUMENTS

| | | | |
|---|---|---|---|
| 1236420 | 6/1971 | United Kingdom | 40/612 |

*Primary Examiner*—John F. Pitrelli
*Assistant Examiner*—G. Lee Skillington
*Attorney, Agent, or Firm*—Joseph J. Baker; Gerald J. Ferguson, Jr.

[57] ABSTRACT

A dasher board for ice skating rinks is disclosed comprising a flat front panel member with a flange adjacent the lower edge to support the panel in a vertical upright position. The panel has a sheet member containing indicia in the form of advertising or the like located adjacent the front portion of the panel and a window means is positioned over the sheet member and secured to the panel. A kickplate is also provided adjacent the lower edge to absorb the impact of hockey pucks and the like. The method of constructing the dasher board is also disclosed.

17 Claims, 4 Drawing Figures

DASHER BOARD FOR ICE SKATING RINKS AND METHOD OF MAKING SAME

BACKGROUND OF THE INVENTION

This invention relates to dasher boards for skating rinks and more specifically to a dasher board having a window secured thereto and means for providing indicia located behind the window.

PRIOR ART, OBJECTS AND SUMMARY OF THE INVENTION

Applicants are unaware of any dasher boards for skating rinks employing the novel features of their invention. U.S. Pat. No. 3,883,120 granted to one of the present applicants discloses one type of dasher board on which the principles of one embodiment of the present invention could be practiced with some modifications to the structure thereof.

It is an important object of the present invention to provide an improved dasher board for skating rinks.

It is another important object of the invention to provide a dasher board having a means for displaying indicia principally in the form of advertisements.

It is another important object of the invention to provide a display means as aformentioned which is resistant to abuse in the form of impact loading and which will not interfere with play or cause injury to those skating on the rink particularly adjacent the display area of the dasher board.

It is another important object of the invention to provide a display means which is relatively inexpensive to install and maintain.

It is another important object of the invention to provide a display means which, due to its unique construction, enables the means for providing the indicia to be rapidly and easily changed and clearly viewed.

Briefly, these and other objects are accomplished by constructing a dasher board having in one embodiment a substantially flat front panel which faces the floor of the rink and when joined with adjacent dasher boards in end to end relationship forms a continuous wall around the periphery of the rink. The dasher board normally has a flange extending at least along the bottom edge which when secured to the floor of the rink maintains the board in a vertical upright position. A kickplate is secured to the base of the front of the board to absorb the impact of hockey pucks and the like. A window of clear plastic-like material is positioned adjacent the front above the kickplate and a means for providing indicia in the form of an advertisement or the like is either placed adjacent the front of the board or is placed on the back of the window. The window is then secured to the front of the panel. In another embodiment, a recess substantially the width of the window and the means for providing indicia is formed in the front of the panel and the window and indicia means are positioned in the recess and secured to the panel such that the front of the panel is smooth and free of obstruction.

Embodiments of the invention are described hereunder in some detail with reference to and are illustrated in the accompanying drawings, in which.

DETAILED DESCRIPTION OF PREFERRED EMBODIMENTS

Figure 2:
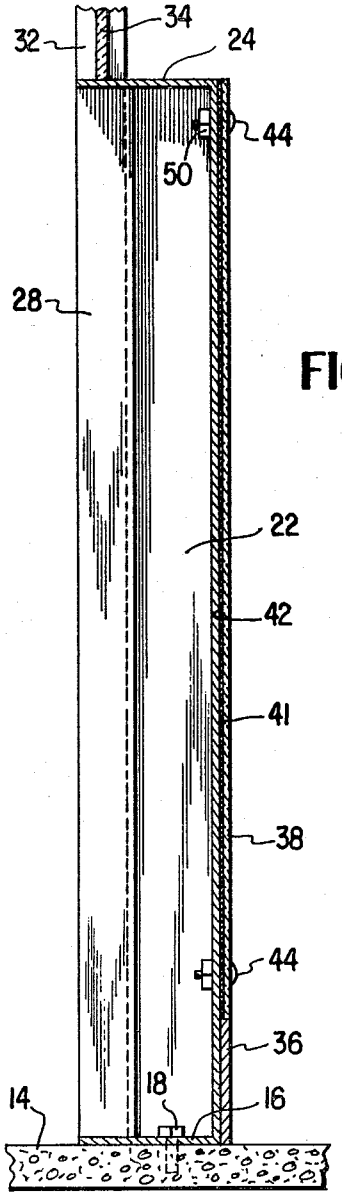
FIG. 2 is a cross-sectional view of the dasher board of FIG. 1 taken along the lines 2—2 thereof.
Figure 1:
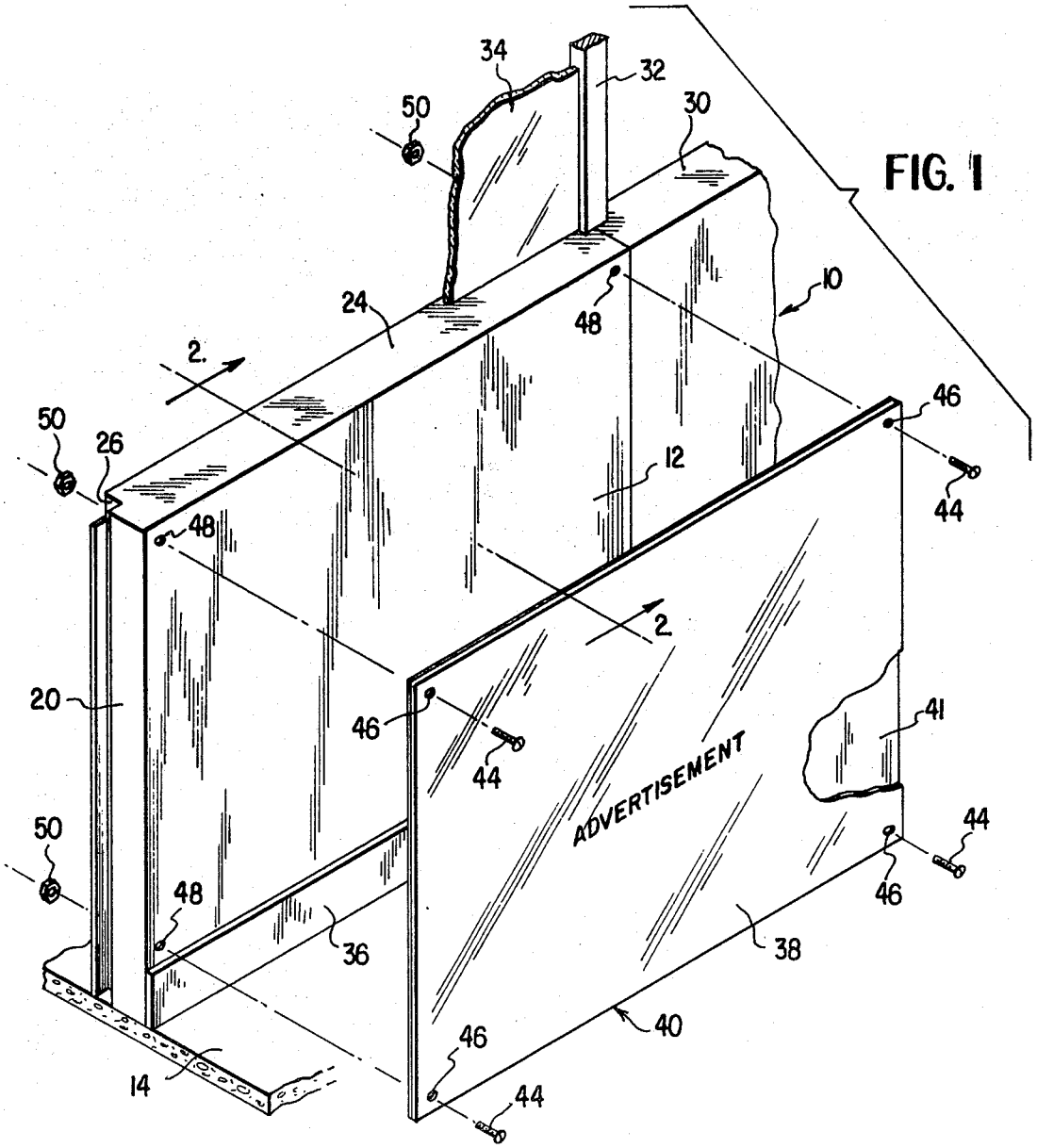
FIG. 1 is a perspective view of one embodiment of a dasher board of the present invention.

Referring now to the drawings where like characters of reference indicate like parts in each of the several views, FIGS. 1 and 2 disclose one embodiment of the present invention wherein numeral 10 indicates generally the novel dasher board of the present invention. The dasher board 10 comprises essentially a panel member 12 having a substantially smooth outer surface which when erected in a vertical upright position would face the floor 14 of the rink. A flange member 16 is secured to the lower edge of the panel member 12 and serves to maintain the dasher board 10 in its aforementioned vertical upright position. In order to eliminate any movement of the panel member 12 relative to the floor 14, bolts 18 can be employed extending through the flange member 16 into the floor 14. Side members 20, 22 and top member 24 are also secured to the panel member 12 adjacent the sides and top thereof to form a reinforcing flange around the panel member 12 and increase its rigidity. Grooves 26, 28 may be formed adjacent the side members 20, 22 respectively which serve to facilitate the joining of additional dasher boards 30 when a post 32 is placed between the grooves of adjacent dasher boards. The post 32 may also serve to support a spectator shield 34 of clear plastic, however, the grooves 26, 28, post 32 and spectator shield 34 do not form a part of this invention and are illustrated only to show one means of joining adjacent dasher boards and providing support for a spectator shield 34. A kickplate 36 is also provided at the bottom of the panel member 12 adjacent the rink floor 14 to absorb the impact of hockey pucks, skates or the like. The panel member 12, flange member 16, side members 20, 22, top member 24 and kickplate 36 can be made of wood, metal, plastic or polyester resinous-type materials or a combination thereof depending on the strength and durability of the dasher board desired.

A window 38 made of a clear plastic-like material is provided substantially the size of the panel member 12 extending above the kickplate 36. A strong, such plastic material resistant to shock and cracking when engaged by hockey pucks, skates and the like is, for example, extruded LEXAN*. In this embodiment, i.e. FIGS. 1 and 2, an advertising member 40 is also provided which can take the form of indicia 41 painted on the side 42 of the window 38 facing the panel member 12 by employing silk-screen techniques or it may be in the form of a decal applied to the side 42 such that the desired message appears through the window 38. The window member 38 is then positioned against the panel member 12 and secured thereto by means of, for example, bolts 44 extending through aligned holes 46 in the window member 38 and holes 48 in the panel member 12 and corresponding nuts 50. When aligned with adjacent dasher boards, the windows 38 present a smooth continuous surface or wall around the periphery of the rink floor 14 while at the same time providing advertisements which are clearly visible to all spectators on the opposite side of the rink and which are protected from damage due to flying hockey pucks, hockey sticks, skates and the skaters themselves.

*Reg. Trademark—General Electric Co.

Figure 4:
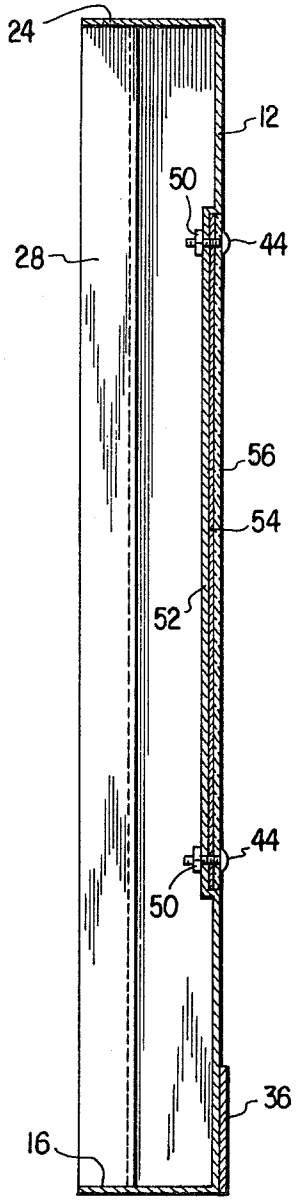
FIG. 4 is a cross-sectional view of the dasher board of FIG. 3 taken along the lines 4—4 thereof.
Figure 3:
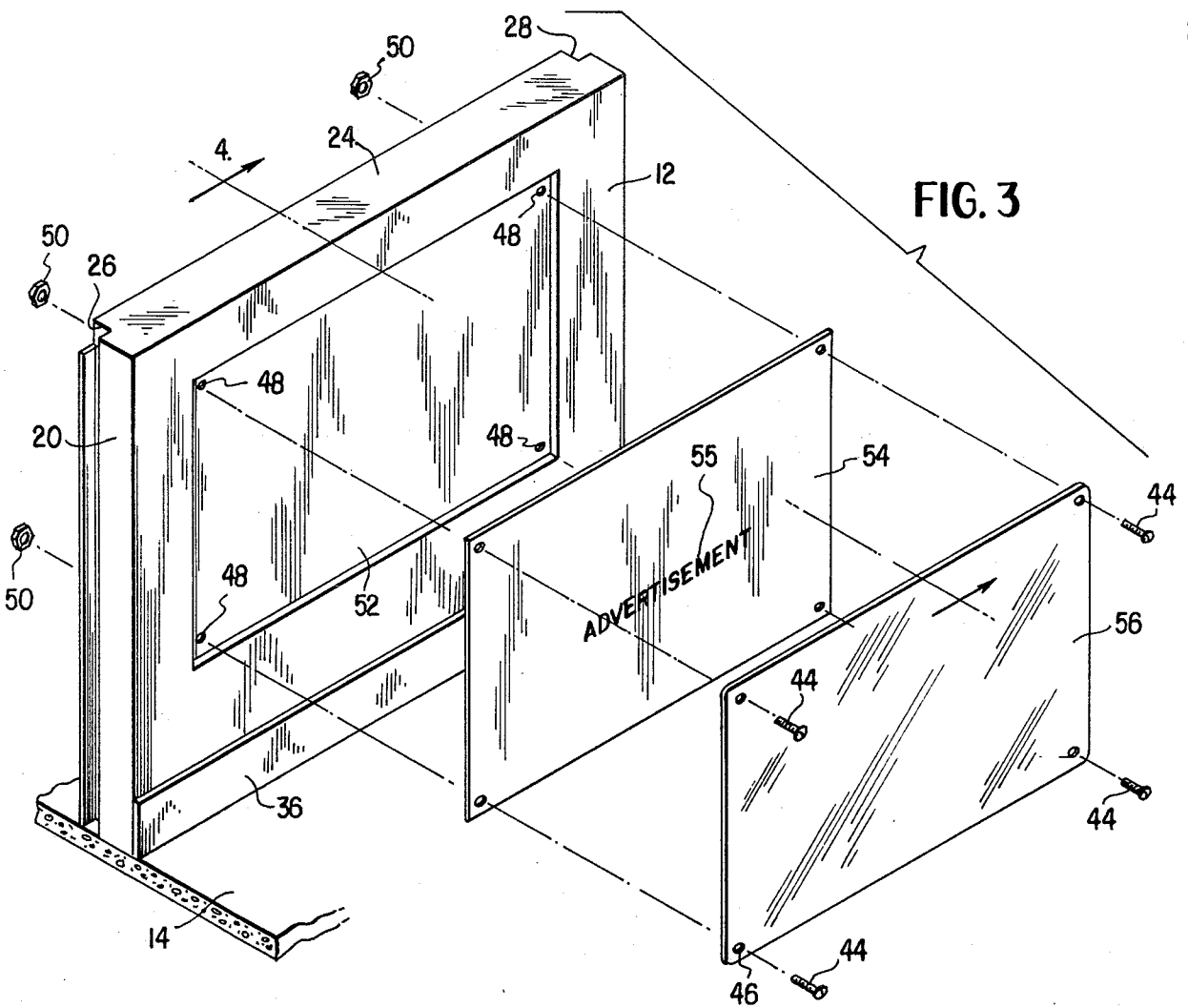
FIG. 3 is a perspective view of another embodiment of a dasher board of the present invention.

In another embodiment of the present invention illustrated in FIGS. 3 and 4, the panel member 12 has a recess 52 formed in the surface thereof. The shape of the recess 52 is preferably rectangular, however, if it is desired, it can be circular, triangular or any other particular shape. An advertising member 54 is provided having the general shape of the recess 52. The advertising member 54 can be indicia 55 printed on a backing such as paper, cloth, cardboard or the like which is positioned in the recess 52. A window 56 is also provided made of the same clear plastic material referred to with regard to the embodiment of FIGS. 1 and 2 and having the same general shape as the recess 52. The window 56 is positioned in the recess 52 over the advertising member 54 and secured to the panel member 12 with bolts 44 and nuts 50 extending through aligned holes in the window 56, panel member 12 and, if necessary for support, the advertising member 54. The depth of the recess 52 should be substantially the same as the combined widths of the window member 56 and advertising member 54 so that when secured in the recess 52, no edge extends beyond the plane of the panel member 12. Such an exposed edge could result in cuts or abrasions if forcefully engaged by a part of the anatomy. The advertising member 54 can be easily changed even on a daily basis by merely removing the bolts 44 and window member 56. It is to be understood, of course, that the advertising member 40 in the form of indicia 41 painted or in decal form could be applied also to the window member 56 in the embodiment of FIGS. 3 and 4 and the advertising member 54 in the form of indicia 55 applied to a paper backing or the like could be inserted between the panel member 12 and the window member 38 in the embodiment of FIGS. 1 and 2 if desired. It also being understood that the principles of the present invention disclosed herein with regard to straight dasher boards apply equally to dasher boards having a curvature.

Applicants have thus disclosed their novel dasher board for skating rinks, one which enables advertisements or the like to be clearly viewed through a window secured thereto. A window which, in either embodiment of the invention, is constructed so as to eliminate any projection thereof which could cause injury to skaters or obstruct or interfere with play on the rink.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A dasher board for ice skating rinks comprising:
(a) a panel member having a substantially flat front portion and a flange member extending perpendicular therefrom for supporting said panel member in a vertical upright position on said rink,
(b) a window on said front portion of said panel,
(c) means for supporting indicia, said means located between said front portion of said panel and said window,
(d) means to secure said window to said panel member, and
(e) means secured to said front portion adjacent said rink for absorbing the impact of hockey pucks and the like.

2. The dasher board as set forth in claim 1 wherein said front portion of said panel has an indented portion on the surface thereof and said means for supporting indicia and said window are positioned in said indented portion.

3. The dasher board as set forth in claim 1 wherein said window is a plate of transparent, highly impact resistant, plastic-like material.

4. The dasher board as set forth in claim 1 wherein said means for supporting indicia is a sheet of material having indicia applied thereto.

5. The dasher board as set forth in claim 1 wherein said securing means extends through said window and said panel member.

6. The dasher board as set forth in claim 1 wherein said securing means extends through said window, said means supporting indicia and said panel member.

7. In combination with a dasher board for ice skating rinks of the type having a panel member with a substantially flat front portion, a flange member adjacent the lower edge of the front portion for maintaining said panel member in a vertical upright position on the rink and a means secured to the front portion adjacent the rink for absorbing the impact of hockey pucks and the like, a window on said front portion of said panel, means for supporting indicia located between said front portion of said panel and said window, and means to secure said window to said panel member.

8. The combination as set forth in claim 7 wherein said front portion of said panel has an indented portion on the surface thereof and said means for supporting indicia and said window are positioned within said indented portion.

9. The combination as set forth in claim 7 wherein said means for supporting indicia is a sheet of material having indicia applied thereto.

10. The method of making a dasher board for ice skating rinks comprising the steps of:
(a) providing a panel member having a substantially flat front portion, a flange member extending perpendicular therefrom for supporting said panel member in a vertical upright position on said rink, and means secured to said front portion adjacent said rink for absorbing the impack of hockey pucks and the like;
(b) placing a window proximate said front portion,
(c) locating a means supporting indicia between said front portion of said panel and said window, and
(d) securing said window to said panel member.

11. The method as set forth in claim 10 wherein said indicia is applied adjacent said front portion.

12. The method as set forth in claim 10 wherein said indicia is formed directly on said window.

13. The method as set forth in claim 10 wherein said front portion of said panel has an indented portion and said provided indicia and said window are located in said indented portion.

14. The method as set forth in claim 10 wherein said means for providing indicia is formed directly on said window.

15. A dasher board for ice skating rinks comprising:
(a) a panel member having a substantially flat front portion and a flange member extending perpendicular therefrom for supporting said panel member in a vertical upright position on said rink,
(b) a window in said front portion of said panel, said window and said front portion of said panel being in the same plane, (c) means for supporting indicia, said means located between said front portion of said panel and said window, (d) means to secure said window means to said panel member, and (e) means secured to said front portion adjacent said rink for absorbing the impact of hockey pucks and the like.

16. A dasher board for ice skating rinks comprising:

(a) a panel member having a substantially flat front portion and a flange member extending perpendicular therefrom for supporting said panel member in a vertical upright position on said rink, (b) a window on said front portion of said panel, said window having an inner surface adjacent said front portion of said panel, (c) indicia formed on said inner surface of said window, (d) means to secure said window to said panel member, and (e) means secured to said front portion adjacent said rink for absorbing the impact of hockey pucks and the like.

17. A dasher board for ice skating rinks comprising:

(a) a panel member having a substantially flat front portion and a flange member extending perpendicular therefrom from supporting said panel members in a vertical upright position on said rink, (b) a window on said front portion of said panel, (c) indicia formed on said front portion of said panel, (d) means to secure said window to said panel member, and (e) means secured to said front portion adjacent said rink for absorbing the impact of hockey pucks and the like.

* * * * *